US006505689B1

(12) United States Patent
Pöysti et al.

(10) Patent No.: US 6,505,689 B1
(45) Date of Patent: Jan. 14, 2003

(54) ARRANGEMENT FOR CONTROLLING ROCK DRILLING

(75) Inventors: Tapani Pöysti, Tampere (FI); Jaakko Niemi, Tampere (FI); Reijo Rämö , Toijala (FI); Timo Muuttonen, Siuro (FI)

(73) Assignee: Sandvik Tamrock Oy (FI)

( * ) Notice: Subject to any disclaimer, the term of this patent is extended or adjusted under 35 U.S.C. 154(b) by 0 days.

(21) Appl. No.: 09/762,114

(22) PCT Filed: Aug. 5, 1999

(86) PCT No.: PCT/FI99/00653

§ 371 (c)(1),
(2), (4) Date: Mar. 28, 2001

(87) PCT Pub. No.: WO00/08303

PCT Pub. Date: Feb. 17, 2000

(30) Foreign Application Priority Data

Aug. 6, 1998 (FI) ..... 981707

(51) Int. Cl.[7] ..... E21B 44/00

(52) U.S. Cl. ..... 173/4; 173/9; 173/11; 173/13; 175/27

(58) Field of Search ..... 173/4, 2, 11, 7, 173/5, 19, 32, 9, 8, 152; 175/27, 24

(56) References Cited

U.S. PATENT DOCUMENTS

| | | | | |
|---|---|---|---|---|
| 3,670,826 A | | 6/1972 | Hansson et al. | |
| 3,823,784 A | | 7/1974 | Feucht | |
| 4,074,771 A | | 2/1978 | Morrison | |
| 4,246,973 A | | 1/1981 | Mayer | |
| 4,271,914 A | | 6/1981 | Dressel | |
| 5,121,802 A | | 6/1992 | Rajala et al. | |
| 5,131,475 A | * | 7/1992 | Beney | 173/11 |
| 5,168,937 A | * | 12/1992 | Hamner | 173/4 |
| 5,529,132 A | * | 6/1996 | Evarts et al. | 173/13 |
| 5,771,981 A | * | 6/1998 | Briggs et al. | 173/4 |
| 5,778,990 A | | 7/1998 | Niemi | |
| 5,913,371 A | * | 6/1999 | Jenne | 175/27 |

FOREIGN PATENT DOCUMENTS

| | | |
|---|---|---|
| DE | 4302755 A1 | 8/1994 |
| WO | 95/28549 | 10/1995 |

* cited by examiner

*Primary Examiner*—Scott A Smith
(74) *Attorney, Agent, or Firm*—Burns, Doane, Swecker & Mathis, L.L.P.

(57) ABSTRACT

The invention concerns an arrangement for controlling a hydraulic rock drilling device. The arrangement includes a pressure ratio valve that is used for adjusting the relation between the pressures in the pressure channel leading to the percussion device and/or another actuator, such as a shank stabilizer, and the pressure channel leading to the feed mechanism. The pressure ratio valve is arranged to keep the relation between the pressures of the actuator and the feed mechanism constant over the normal drilling range.

22 Claims, 4 Drawing Sheets

ARRANGEMENT FOR CONTROLLING ROCK DRILLING

The invention concerns an arrangement for controlling a hydraulic rock drilling device, said arrangement including a rock drill equipped with at least one actuator, a feed motor for feeding the rock drill in the drilling direction and reversing, a hydraulic pressure pump and the hydraulic fluid channels connected to it for feeding hydraulic fluid to each actuator and to the feed motor, and a return channel leading to a hydraulic fluid tank for returning hydraulic fluid to the hydraulic fluid tank, and valves for directing hydraulic fluid flow to each actuator and to the feed motor.

A variety of rock drilling control methods have been used with the aim to improve drilling results as well as to prevent the equipment from breaking. In many cases, the intent is to optimize the drilling process in some way to satisfy both cost and production objectives. A quite common principle is to use low feed speed and percussion power during collaring and, when collaring is completed, switch over to full feed speed and percussion power. This change-over is accomplished by either directly shifting from collaring values to normal drilling values or through a suitable ramp between them.

In the known controlling methods for drilling, the relation of feed pressure and percussion mechanism pressure is regulated so that the pressure difference between them remains constant. There are also solutions where both the percussion mechanism pressure and the feed pressure are connected to follow the hydraulic fluid pressure of the rock drill rotation motor.

The known solutions have several disadvantages. When regulating is based on constant pressure difference between percussion and feed pressures, it does not work optimally over a wide drilling power range. Therefore, at the extremes of the operating range of drilling either underfeed or overfeed will occur. This is especially the case when difference between feed pressure and percussion mechanism pressure values is great. Correspondingly, a small difference in the pressure values easily causes the percussion pressure to drop below the minimum set value when feed pressure drops, for instance, due to soft material, and this leads to problems in drilling.

U.S. Pat. No. 4,074,771 presents a solution where feed is adjusted using a manual control lever. The publication discloses that the operation of the percussion mechanism is installed to follow feed motor pressure so that when feed motor pressure exceeds a set limit value the hydraulic pressure in the percussion mechanism will rise in accordance with feed pressure. The publication states that during normal drilling the extreme position of the control lever will provide feed and percussion at maximum power. In this situation, the hydraulic pressure of the rotation motor is also connected to follow feed pressure so that if feed pressure decreases, rotation power will also decrease. The solution presented in the publication is complex, and its operation in drilling is not optimal. When feed, percussion, and rotation are connected to be regulated simultaneously, problems will arise and, for instance, collaring is difficult.

The purpose of this invention is to provide an arrangement for controlling rock drilling equipment so that drilling with all its phases can be easily and effectively realized, and that is uncomplicated for the operator to manage. The arrangement according to the invention is characterized in that the arrangement includes a pressure ratio valve that is connected during drilling to control the pressure of the hydraulic fluid fed to at least one actuator according to the pressure of the hydraulic fluid fed to the feed motor so that at least when the pressure of the hydraulic fluid fed to the feed motor exceeds a preset value the pressure ratio valve will control the pressure of the hydraulic fluid flowing to the actuator in a way that a change in the feed pressure causes a pressure change in the pressure of the hydraulic fluid fed to the actuator, and that this change has a constant relation to the pressure change in the hydraulic fluid fed to the feed motor as determined by the pressure ratio valve.

The essential idea of the invention is that the relation of the pressures in the pressure channel to the percussion mechanism and/or other actuator, such as the shank stabilizer, and in the pressure channel to the feed mechanism is regulated using a pressure ratio valve that will maintain the relation of the pressures to the actuator and the feed mechanism constant in the normal drilling range. A preferred version of the invention has a separate pressure relief valve connected to the actuator's pressure channel, which keeps the hydraulic pressure to the actuator at a preset minimum pressure value in a situation where a pressure ratio valve would adjust the actuator's pressure, in relation to feed mechanism pressure, lower than the said minimum pressure value.

A benefit of an arrangement pursuant to the invention is that percussion and feed functions, or the functions of another actuator and feed, are in a more favourable relation to one another with low as well as high power. A further benefit is that when using a simple pressure ratio valve, based on the surface areas of the regulator, it is easy and fast to change over to the desired pressure relation as required by the characteristics of the equipment and the drilling conditions. The preferred version of the invention has the further benefit, when a minimum pressure valve is used, of offering the possibility to set, for instance, the percussion mechanism minimum pressure such that under suitable conditions the percussion mechanism will also operate even with very low power.

BRIEF DESCRIPTION OF THE DRAWINGS

The invention is described in more detail in the attached drawings, of which

DETAILED DESCRIPTION

Figure 1:
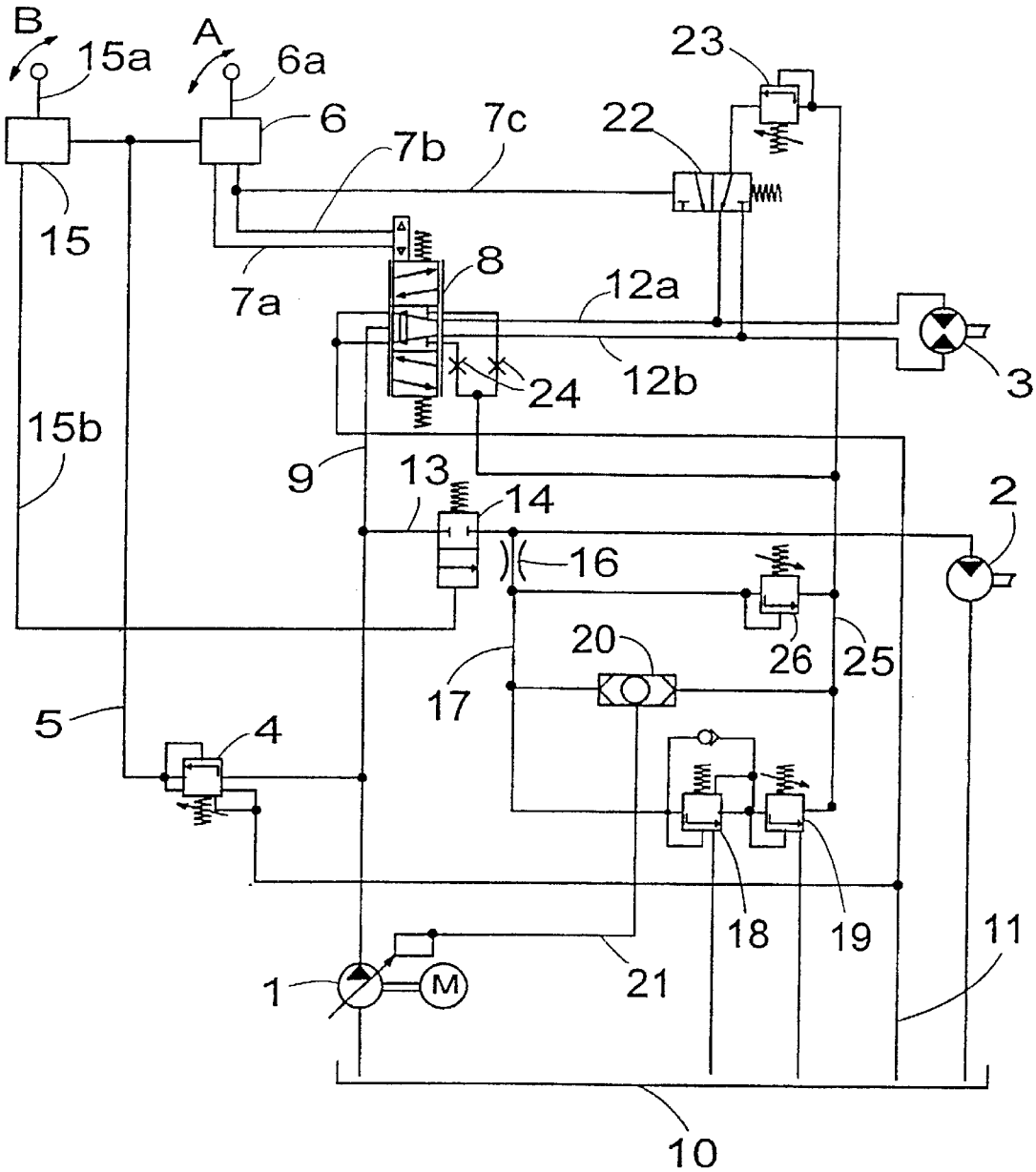
FIG. 1 presents a schematic drawing of one embodiment of an arrangement pursuant to the invention.

FIG. 1 presents a schematic drawing of the hydraulic connections for controlling a rock drilling device. This arrangement includes a hydraulic pressure pump 1, preferably a pressure-controlled volume flow pump. It also includes a percussion device 2, in this case an actuator pursuant to the invention in question, and a feed motor 3 that are intended to be driven by hydraulic fluid fed by the hydraulic pressure pump 1. The feed motor 3 can be in different implementations either a hydraulic motor or a cylinder, but in this patent application they are both referred to as feed motor. In order to control the operation of the feed motor, a pressure reducing valve 4 is connected to the hydraulic pressure channel from the hydraulic pressure pump with the purpose of lowering the hydraulic fluid pressure to a level suitable for the operation of the control valves in the connection arrangement. From the pressure reducing valve 4, a control pressure channel 5 leads to a feed control valve 6 that controls the feed of the feed motor. The feed control valve 6 is, as such, a known pressure regulating valve whose position and, thus, the pressure of the outflowing hydraulic fluid is regulated with a control lever 6*a*. The control lever 6*a* can be shifted from its middle position, i.e. neutral position, in both directions as indicated by arrow A, which makes it possible to regulate both forward and reverse feed using the same regulator. Two feed control channels, 7*a* and 7*b,* come from the feed control valve 6 and they are connected to control feed control valve 8. The feed control valve 8 is a 2-way proportional valve, and the hydraulic fluid flow through it is proportional to the control pressure affecting the valve. Also connected to the feed control valve 8 is feed pressure channel 9 directly connected to the hydraulic pressure pump and leading hydraulic fluid controlled by the feed control valve 8 to the feed motor 3.

Return channel 11 from the feed control valve 8 to hydraulic fluid tank 10 leads the hydraulic fluid return flow from the feed motor 3 to the hydraulic fluid tank. Two feed motor channels, 12*a* and 12*b,* are also connected from the feed motor 3 to the feed control valve 8 and used for making the feed motor 3 operate in the desired direction depending on the control of the feed control valve 8. When hydraulic fluid is directed with the feed control valve 6 to the channel 7*a* it causes the feed motor 3 to feed the rock drill and, thus, also the drill rod forwards. Correspondingly, when the control lever 6*a* is turned in the opposite direction, the control pressure channel 7*b* becomes pressurized and causes the feed control valve 8 to move into a position where the feed motor 3 produces return movement. The movement speed generated by the feed motor 3 is proportional to the pressure value reached in the channel 7*a* or 7*b* and, thus, the desired speed of movement is reached by changing the position of the control lever 6*a*.

Percussion channel 13 leads high-pressure hydraulic fluid from the hydraulic pressure pump 1 to percussion valve 14 that can be used for connecting it to flow to the percussion device 2. From the percussion device 2, a separate hydraulic fluid return channel leads to the hydraulic fluid tank 10. The percussion valve 14 is controlled by a separate percussion control valve 15. This is done, for instance, by turning control lever 15*a* from its neutral position to another position in the direction of arrow B, whereby the control pressure in channel 15*b* opens the valve 14 which then allows hydraulic fluid to flow to the percussion device 2.

To control the percussion pressure of the percussion device, the pressure channel of the percussion device has throttle 16. The throttle 16 is connected via control channel 17 to pressure ratio valve 18 and minimum pressure limit valve 19 connected in series with the former. The channel 17 is also connected to flow control channel 21 of the hydraulic pressure pump via shuttle valve 20.

The feed motor channels 12*a* and 12*b* are connected to pressure-controlled change-over valve 22 with feed control channel 7*c* connected to control it. The valve 22 is also connected to feed pressure control valve 23. The valve 22 connects the feed pressure control valve 23 always with that feed motor channel along which the pressureless hydraulic fluid from the feed motor 3 is returning. From the feed control valve 8, pressurized hydraulic fluid enters via throttles 24 to channel 25, and into connection with the feed pressure control valve 23. The channel 25 is further in connection via the shuttle valve 20 with pressure regulating channel 21 of the hydraulic pressure pump 1.

The figure also shows pressure relief valve 26 that is connected between the control channel 17 and the channel leading to the hydraulic fluid tank 10. The valve 26 restricts the maximum pressure fed to the percussion device 2 to a preset value so that the highest allowed operating pressure is not exceeded. Therefore, when the pressure of the hydraulic fluid fed to the percussion device is below this set limit value, the valve 26 is not in operation.

The system operates as follows. When drilling is started, percussion control pressure is connected from the percussion control valve 15, whereby the percussion valve 14 changes position and allows hydraulic fluid from the hydraulic pressure pump to flow along the channel 13 to the percussion device 2. In this situation, the minimum pressure of the percussion device assumes the level determined by the pressure limit valve 19. When the feed control valve 6 is used for increasing hydraulic fluid flow to the feed motor 3, the counter-force caused by drilling resistance increases the pressure of the hydraulic fluid flowing to the feed motor 3. This, on the other hand, causes the pressure in the channel 25 to increase correspondingly, and the pressure ratio valve 18 tends to increase the hydraulic fluid pressure to the percussion device 2 in constant relation. As the pressure to the feed motor 3 increases, the pressure value regulated by the pressure ratio valve 18 will, at some point, exceed the minimum pressure limit set by the pressure limit valve 19. In this phase, the pressure of the hydraulic fluid flowing to the percussion device follows the pressure value to the feed motor in a certain constant relation controlled by the pressure ratio valve 18 as long as the resulting pressure value exceeds the said minimum pressure value. In a situation where the resulting pressure value would, however, exceed the maximum allowed safe operating pressure, the pressure relief valve 26 will limit the pressure to the percussion device to the said maximum pressure value.

The minimum pressure limit valve 19 can be any type of pressure limiting valve that maintains a certain pressure value as the invention presupposes. Correspondingly, the pressure ratio valve 18 can be a valve of any configuration as long as it maintains the pressure relation between two hydraulic fluid channels at least essentially constant. Preferably this is achieved by using a pressure ratio valve where the relation of the pressures is determined by the inverted relation of the surface areas of the valve spool, which keeps the relation always fixed. By using a plug-like cartridge valve as the pressure ratio valve, the desired feed/percussion pressure relation can easily be changed when the device and equipment or the drilling conditions so require. Also, if several valves with different pressure relations are mounted in a suitable valve block and a suitable set of valves is connected for selecting the desired pressure ratio valve, the pressure relation can be selected with a suitable connection either manually or automatically.

Figure 2:
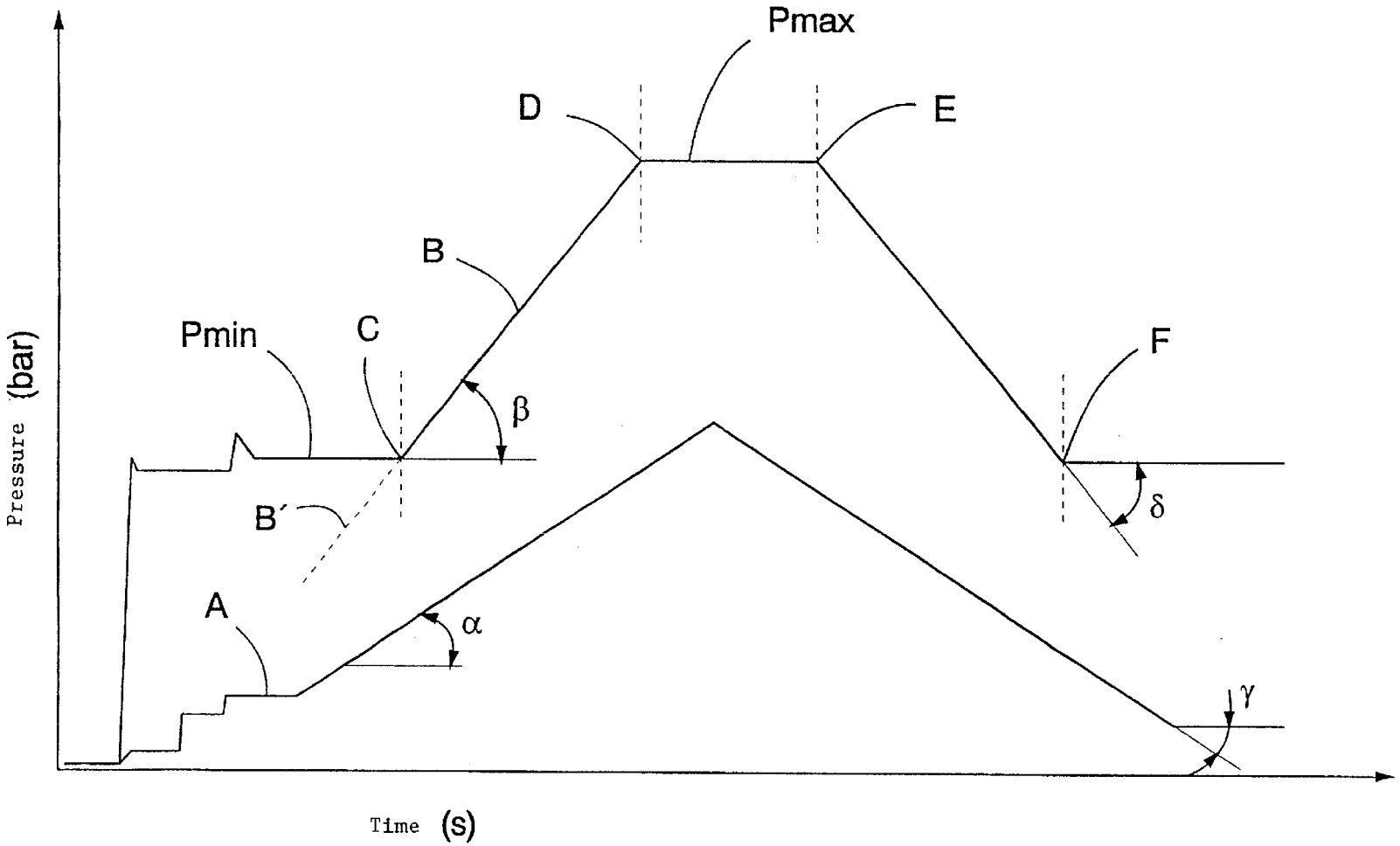
FIG. 2 presents a schematic diagram of the pressure curves of an application of the invention pursuant to FIG. 1.

FIG. 2 shows schematically diagram of the pressure curves achieved by the application pursuant to the invention and shown in FIG. 1. The lower curve A in the diagram indicates the hydraulic fluid pressure fed to the feed motor, and the upper curve B indicates the hydraulic fluid pressure fed to the percussion device. As the diagram shows, the feed pressure according to curve A starts low and then rises at a certain angle a when feed is increased and, correspondingly, descends when feed is decreased. Percussion pressure, on the other hand, assumes the preset minimum pressure value Pmin at the beginning, and starts rising in the direction of the angle$\beta$ only after the point indicated by the vertical line C. Therefore, the relation between feed pressure A and percussion pressure B remains constant in this situation. As indicated by the dotted line B', continuation of curve B, percussion pressure would otherwise be lower if controlled by the pressure relation valve 18 at the start of drilling, but the minimum pressure limit valve 19 keeps it at the minimum value above the dotted line.

When feed pressure is increased further, the maximum pressure value allowed for the percussion device would be exceeded at the point indicated by the vertical line D. Therefore, despite the rising feed pressure, the pressure relief valve 26 in FIG. 1 limits percussion pressure at this point to its maximum value Pmax and keeps it there although feed pressure rises. Correspondingly, at point E, when feed pressure decreases percussion pressure starts decreasing so that their relation remains constant. This is indicated by the fact that when feed pressure is steadily lowered at an angle δ percussion pressure decreases steadily at a constant angle γ. At point F, percussion pressure has again reached the value determined by the minimum pressure limit valve 19, in FIG. 1, and remains at that level despite the feed pressure being lowered further as feed is decreased.

Figure 3:
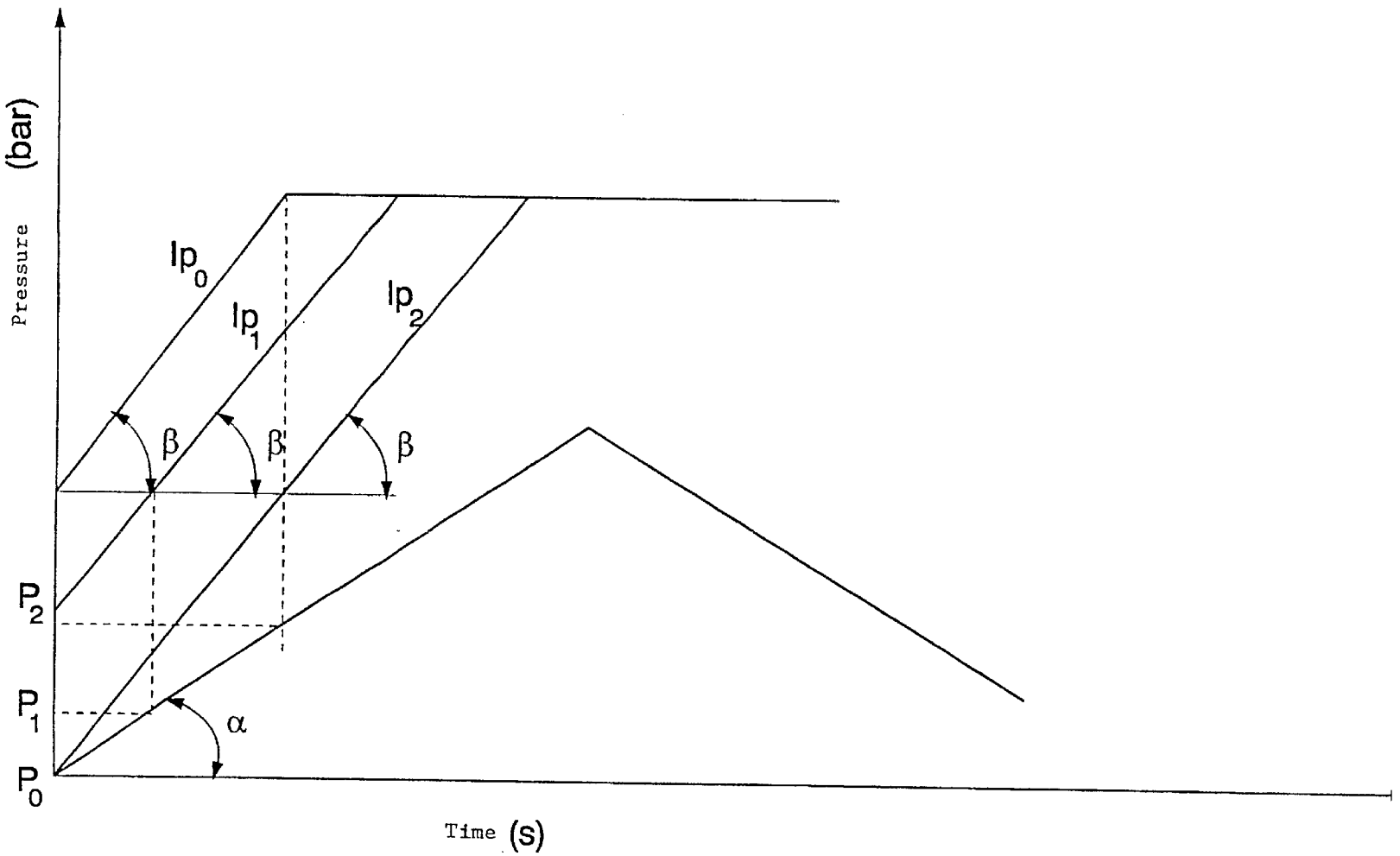
FIG. 3 presents a schematic diagram of the pressure curves of one application of the invention pursuant to FIG. 1.

FIG. 3 shows schematically a diagram of how the pressure ratio valve 18 can be used for separately setting a value at which the pressure ratio valve starts regulating the pressure of the hydraulic fluid flowing to the percussion device 2. The diagram shows three alternative settings. With the setting $P_0$ the pressure relation valve 18 starts regulating the hydraulic fluid flowing to the percussion device in relation to the hydraulic fluid flowing to the feed mechanism, following the curve $IP_0$. Correspondingly, when the regulating value of the pressure relation valve 18 is set, for instance, according to pressures $P_1$ and $P_2$, the resulting curves are $IP_1$ and $IP_2$. In this way, it is possible to set the desired change of pressures to suit the drilling conditions and the equipment as well as the drilled material as well as possible. As the setting of the pressure ratio valve 18 is infinitely adjustable, the number of alternatives and possible settings between the minimum and maximum values of the setting range is, of course, infinite. The essential thing is, however, that once the pressure relation adjustment is in operation the changes in feed and percussion pressures always are in the constant relation to one another determined by the pressure ratio valve.

Figure 4:
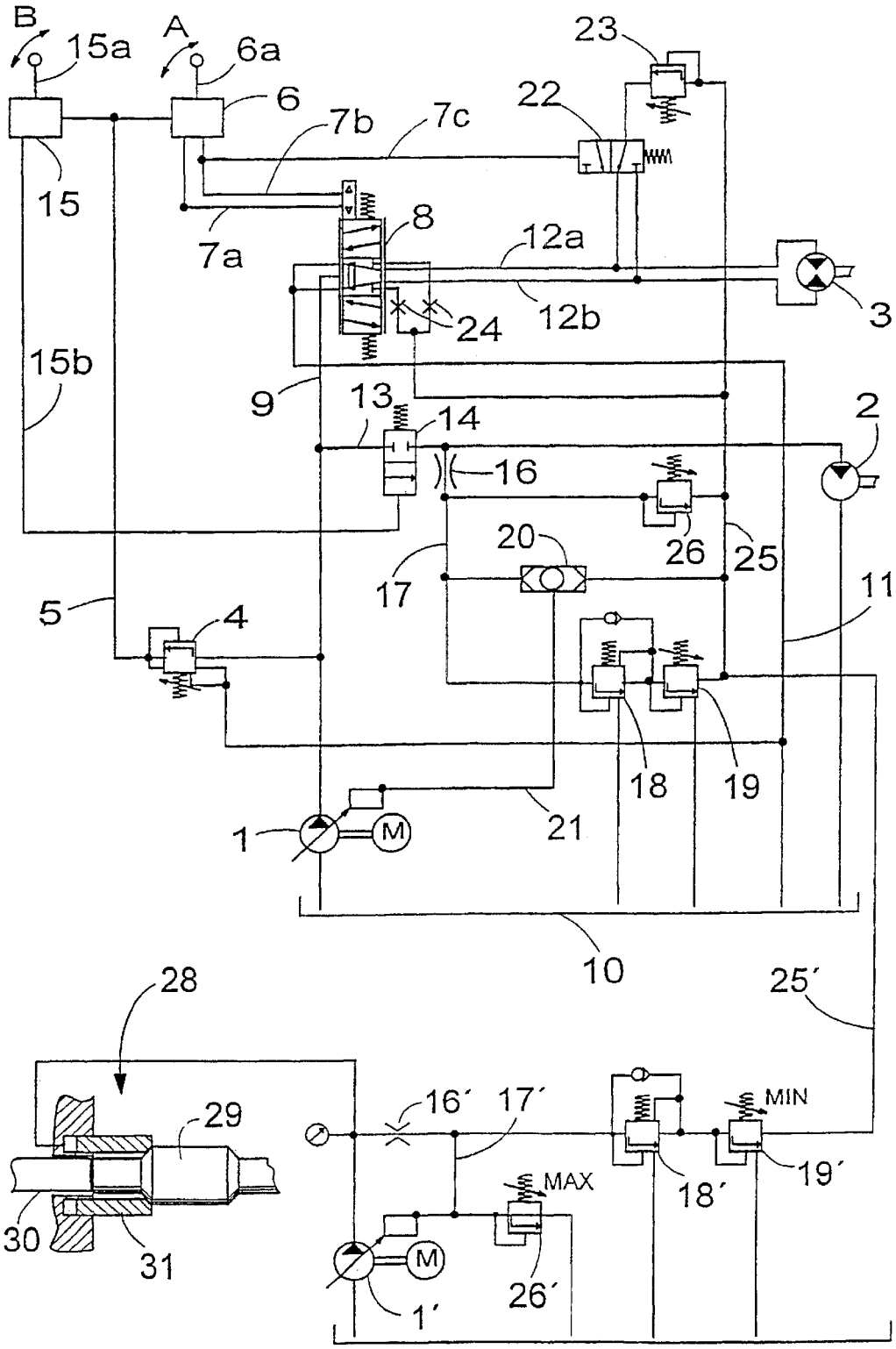
FIG. 4 presents a schematic drawing of another version of an arrangement pursuant to the invention.

FIG. 4 presents a schematic drawing of another version of an arrangement pursuant to the invention. In this version, the parts of the hydraulic connections concerning percussion and feed mechanisms and their regulation are identical to those in FIG. 1. In addition to that, the drawing shows a so-called shank stabilizer 28 that is used for adjusting the position of the rock drill shank in relation to its intended, so-called optimal impact point. The optimal impact point means the point where as much as possible of the impact power of the percussion device intended for the shank 29 can be transferred from the impact piston 30 to the shank 29. A stabilizer 28 of this kind has a separate piston structure that may contain one sleeve-like piston 31, as shown in the drawing, located behind the shank 29, i.e. at the side facing the impact piston. Hydraulic fluid is fed behind the piston 31 with a pressure adjusted so that the desired position of the shank in relation to the optimal impact point is achieved, in normal drilling this means at the optimal impact point. In stead of one sleeve-like piston 31, two or more sleeve-like pistons may be used, or several pistons located in ring form around the shank axis and connected in some way to affect the shank by pushing it forwards with the aid of the said hydraulic fluid pressure. Such stabilizer solutions of various configuration are generally known, and their structure and operation are generally known and self-evident to the person skilled in the art.

The components for controlling the stabilizer shown in the drawing are, in principle, identical to those in FIG. 1 for the control of the percussion device, and they have the same identifying numbers, but provided with apostrophes. The operation and connections of the components from the point of pressure regulation is the same as that explained in FIG. 1 for the pressure control of the percussion device and, therefore, it need not be separately explained again in this conjunction. The essential thing is that the hydraulic fluid pressure fed behind the stabilizer piston 31, or possibly several pistons, is regulated in relation to the pressure fed to the feed motor, in the same way as the regulation of the pressure fed to the percussion device was explained in conjunction with FIG. 1.

The invention is presented in the above explanations and drawings in the light of examples and it is in no way restricted to them. Essential to the invention is that the arrangement contains the equipment with which the percussion device pressure is controlled in relation to the feed motor feed pressure so that their relation is maintained essentially constant. According to one preferred version of the invention, the essential thing is that the hydraulic fluid pressure of the percussion device is kept at least at a preset minimum pressure value so that not until the percussion pressure relative to the feed motor feed pressure exceeds the said minimum value, the percussion pressure starts following feed pressure in the said constant relation. The invention can be applied so that pressure regulation is used for the regulation of either the percussion device, the stabilizer, or other actuator, or for the regulation of two or more actuators pursuant to the principle of the invention. In this case, depending on the actuators the same pressure regulation may be used for two or more actuators, or a separate regulation for each of them.

What is claimed is:

1. An arrangement for controlling a hydraulic rock drilling device, comprising:

a rock drill equipped with at least one actuator, a feed motor for feeding the rock drill in a drilling direction and reversing, a hydraulic pressure pump, hydraulic fluid channels connected to the hydraulic pressure pump for feeding hydraulic fluid to each of the at least one actuator and the feed motor, a return channel leading to a hydraulic fluid tank for returning hydraulic fluid to the hydraulic fluid tank, valves for directing hydraulic fluid flow to each actuator and to the feed motor, a pressure ratio valve connected during drilling to control a pressure of the hydraulic fluid fed to the at least one actuator according to a pressure of the hydraulic fluid fed to the feed motor so that, at least when the pressure of the hydraulic fluid fed to the feed motor exceeds a preset value, the pressure ratio valve controls the pressure of the hydraulic fluid flowing to the actuator so that a change in the pressure of the hydraulic fluid fed to the feed motor causes a pressure change in the pressure of the hydraulic fluid fed to the actuator, the pressure change in the pressure of the hydraulic fluid fed to the actuator having a constant relation to the pressure change in the hydraulic fluid fed to the feed motor as determined by the pressure ratio valve.

2. An arrangement according to claim 1, wherein the pressure ratio valve is connected between a hydraulic fluid channel feeding hydraulic fluid during drilling to the feed motor and a hydraulic fluid channel leading hydraulic fluid to the actuator.

3. An arrangement according to claim 2, further comprising a separate pressure limit valve that keeps the pressure of the hydraulic fluid flowing to the actuator at a preset minimum value until the pressure value of the hydraulic fluid directed by the pressure ratio valve to the actuator exceeds the minimum pressure limit.

4. An arrangement according to claim 3, wherein the pressure ratio valve includes a regulating organ for setting a limit value for the pressure of the hydraulic fluid fed to the feed motor and above which limit value the pressure ratio valve adjusts the pressure of the hydraulic fluid flowing to the actuator.

5. An arrangement according to claim 3, wherein the pressure ratio valve includes a plurality of pressure ratio valves of different pressure relations, and at least one control valve for selecting one of the plurality of pressure ratio valves corresponding to a desired pressure relation.

6. An arrangement according to claim 3, wherein the at least one actuator includes a plurality of actuators, and each actuator of the plurality of actuators has its own pressure ratio valve for regulating the pressure of the hydraulic fluid fed to the actuator of the plurality of actuators.

7. An arrangement according to claim 2, wherein the pressure ratio valve includes a plurality of pressure ratio valves of different pressure relations, and at least one control valve for selecting one of the plurality of pressure ratio valves corresponding to a desired pressure relation.

8. An arrangement according to claim 2, wherein the at least one actuator includes a plurality of actuators, and each actuator of the plurality of actuators has its own pressure ratio valve for regulating the pressure of the hydraulic fluid fed to the actuator of the plurality of actuators.

9. An arrangement according to claim 1, further comprising a separate pressure limit valve that keeps the pressure of the hydraulic fluid flowing to the actuator at a preset minimum value until the pressure value of the hydraulic fluid directed by the pressure ratio valve to the actuator exceeds the minimum pressure limit.

10. An arrangement according to claim 2, wherein the pressure ratio valve includes a regulating organ for setting a limit value for the pressure of the hydraulic fluid fed to the feed motor and above which limit value the pressure ratio valve adjusts the pressure of the hydraulic fluid flowing to the actuator.

11. An arrangement according to claim 9, wherein the pressure ratio valve includes a regulating organ for setting a limit value for the pressure of the hydraulic fluid fed to the feed motor and above which limit value the pressure ratio valve adjusts the pressure of the hydraulic fluid flowing to the actuator.

12. An arrangement according to claim 9, wherein the pressure ratio valve includes a plurality of pressure ratio valves of different pressure relations, and at least one control valve for selecting one of the plurality of pressure ratio valves corresponding to a desired pressure relation.

13. An arrangement according to claim 9, wherein the at least one actuator includes a plurality of actuators, and each actuator of the plurality of actuators has its own pressure ratio valve for regulating the pressure of the hydraulic fluid fed to the actuator of the plurality of actuators.

14. An arrangement according to claim 1, wherein the pressure ratio valve is a replaceable valve.

15. An arrangement according to claim 14, wherein the pressure ratio valve includes a plurality of pressure ratio valves of different pressure relations, and at least one control valve for selecting one of the plurality of pressure ratio valves corresponding to a desired pressure relation.

16. An arrangement according to claim 1, wherein the pressure ratio valve includes a regulating organ for setting a limit value for the pressure of the hydraulic fluid fed to the feed motor and above which limit value the pressure ratio valve adjusts the pressure of the hydraulic fluid flowing to the actuator.

17. An arrangement according to claim 1, wherein the pressure ratio valve includes a plurality of pressure ratio valves of different pressure relations, and at least one control valve for selecting one of the plurality of pressure ratio valves corresponding to a desired pressure relation.

18. An arrangement according to claim 1, wherein the at least one actuator includes a plurality of actuators, and each actuator of the plurality of actuators has its own pressure ratio valve for regulating the pressure of the hydraulic fluid fed to the actuator of the plurality of actuators.

19. An arrangement according to claim 1, wherein the at least one actuator includes a plurality of actuators, and at least one actuator of the plurality of actuators is a percussion device.

20. An arrangement according to claim 1, wherein the at least one actuator includes a plurality of actuators, and at least one actuator of the plurality of actuators is a shank stabilizer.

21. An arrangement according to claim 1, wherein the at least one actuator is a percussion device.

22. An arrangement according to claim 1, wherein the at least one actuator is a shank stabilizer.

* * * * *